US007536729B2

(12) United States Patent
Strauss et al.

(10) Patent No.: US 7,536,729 B2
(45) Date of Patent: May 26, 2009

(54) COSTUME WITH FLEXURE ELEMENT

(75) Inventors: Michael Strauss, Signal Hill, CA (US); John Rosella, Jr., Redondo Beach, CA (US)

(73) Assignee: Mattel, Inc., El Segundo, CA (US)

( * ) Notice: Subject to any disclaimer, the term of this patent is extended or adjusted under 35 U.S.C. 154(b) by 343 days.

(21) Appl. No.: 11/422,298

(22) Filed: Jun. 5, 2006

(65) Prior Publication Data

US 2007/0118953 A1 May 31, 2007

Related U.S. Application Data

(60) Provisional application No. 60/688,038, filed on Jun. 6, 2005.

(51) Int. Cl.
*A41D 13/00* (2006.01)

(52) U.S. Cl. ..... 2/69; 2/DIG. 3

(58) Field of Classification Search ..... 446/320, 446/199, 26, 27, 28; 472/133, 70; 2/46, 2/88, 77, 80, 83, 115, 69, DIG. 3
See application file for complete search history.

(56) References Cited

U.S. PATENT DOCUMENTS

| | | | | |
|---|---|---|---|---|
| 3,731,426 | A | | 5/1973 | Lewis et al. |
| 4,183,171 | A | | 1/1980 | Terzian |
| 4,310,927 | A | | 1/1982 | DeBose |
| 4,819,547 | A | | 4/1989 | Kukolj |
| 4,977,623 | A | | 12/1990 | DeMarco |
| 5,079,778 | A | | 1/1992 | Sloot |
| 5,104,346 | A | | 4/1992 | Smrt |
| 5,158,492 | A | * | 10/1992 | Rudell et al. ..... 446/175 |
| 5,205,774 | A | | 4/1993 | Smrt |
| 5,221,222 | A | | 6/1993 | Townes |
| 5,419,729 | A | | 5/1995 | Gross |
| 5,474,485 | A | | 12/1995 | Smrt |
| 5,664,983 | A | | 9/1997 | Hollis |
| 5,747,144 | A | | 5/1998 | Beige et al. |

(Continued)

OTHER PUBLICATIONS

International Preliminary Report on Patentablity and Written Opinion of the International Searching Authority, dated Sep. 24, 2007, for the corresponding international application No. PCT/US2006/22093.

(Continued)

*Primary Examiner*—Gary L. Welch
*Assistant Examiner*—Amber R Anderson
(74) *Attorney, Agent, or Firm*—Kolisch Hartwell, P.C.

(57) ABSTRACT

A costume may include a flexible garment and a flexure mechanism that is actuatable to expand the form of the garment, such as when a muscle is flexed. The flexible garment may be configured to cover at least a portion of a limb of a humanoid figure, such as a person or doll. The flexure mechanism may be covered by and extend along a portion of the garment. In some examples, a first end of the flexure mechanism may be fixed in position relative to the garment, and a second end moveable relative to the garment and relative to the first end. The flexure mechanism may include an intermediate portion between the first and second ends, with the flexure mechanism being configured to move the intermediate portion laterally toward or away from an articulating member of the limb by movement of the second end of the flexure mechanism.

19 Claims, 8 Drawing Sheets

U.S. PATENT DOCUMENTS

| | | | |
|---|---|---|---|
| 6,067,892 | A | 5/2000 | Erickson |
| 6,223,648 | B1 | 5/2001 | Erickson |
| RE37,533 | E | 1/2002 | Beige et al. |
| 6,568,984 | B1 | 5/2003 | Applewhite |
| 6,805,606 | B1 | 10/2004 | Kellum |
| 2002/0026794 | A1 | 3/2002 | Shahinpoor et al. |
| 2002/0116741 | A1 | 8/2002 | Young |
| 2004/0221355 | A1 | 11/2004 | Garcia |
| 2005/0034208 | A1 | 2/2005 | Fung |

OTHER PUBLICATIONS

Office Action received in corresponding Chinese Patent Application No. 200680026002.1.

* cited by examiner

COSTUME WITH FLEXURE ELEMENT

RELATED APPLICATIONS

This application claims the benefit of U.S. Provisional Application No. 60/688,038, filed Jun. 6, 2005, incorporated herein by reference in its entirety for all purposes.

BACKGROUND

The present disclosure relates generally to costumes for children of all ages, and to dolls and action figures with articulating joints. Costumes provide people with the opportunity to portray a person of unusual character, which character may be represented by attire associated with the character. For example, it is popular to wear a costume of a hero or heroin character. One example of such a character is the proprietary character Superman, which character is known for his great strength and ability to fly. The character Superman is known for wearing a blue body suit having a big red "S" on the chest and a red cape. People, then, portray the character Superman by wearing a costume, or part of a costume that is similar to the costume Superman is known to wear.

Costumes, whether for people or dolls, may provide entertainment in the form of a portion of the costume that can be made to expand and contract, or otherwise change shape, such as when a muscle, like the bicep, is flexed. Examples of devices and apparatus that may represent muscular bodies or bodies that change in shape are disclosed in one or more of the following U.S. patents and published patent applications: U.S. Pat. Nos. 3,731,426; 4,183,171; 4,310,927; 4,819,547; 4,977,623; 5,079,778; 5,104,346; 5,205,774; 5,221,222; 5,419,729; 5,474,485; 5,664,983; 5,747,144; 6,067,892; 6,223,648; 6,568,984; 6,805,606; RE37533; 2002/0026794; 2002/0116741; 2004/0221355; and 2005/0034208. These references are incorporated by reference herein in their entirety for all purposes.

SUMMARY

A costume may include a flexible garment and a flexure mechanism that is actuatable to expand the form of the garment, such as when a muscle is flexed. The flexible garment may be configured to cover at least a portion of a limb of a humanoid figure, such as a person or doll. The flexure mechanism may be covered by and extend along a portion of the garment. In some examples, a first end of the flexure mechanism may be fixed in position relative to the garment, and a second end moveable relative to the garment and relative to the first end. The flexure mechanism may include an intermediate portion between the first and second ends, with the flexure mechanism being configured to move the intermediate portion laterally between an extended position in which the intermediate portion is spaced a first distance from a line extending between the first and second ends, and a retracted position that is closer to the line extending between the first and second ends than the extended position. Movement between the extended and retracted positions may be associated with movement of the second end between a distal position spaced a second distance from the first end and a proximal position that is closer to the first end than the distal position.

The disclosed flexure mechanism may be used over a joint connecting two structural or articulated members, such as arm or leg members, to allow articulation. When a joint moves, a degree of realism may be portrayed by a flexure element that projects laterally from one or more of the articulating members, when the members are articulated. For example, the costume may have muscular features corresponding to an action figure, such as the character Superman. The flexure mechanism may act on a garment covering the flexure mechanism, thereby providing a flexure element in the form of a muscle surface, for example, representing the bicep area that flexes or extends away from the upper arm, when the lower arm is moved toward the upper arm.

DETAILED DESCRIPTION OF THE PREFERRED EMBODIMENT

Figure 1:
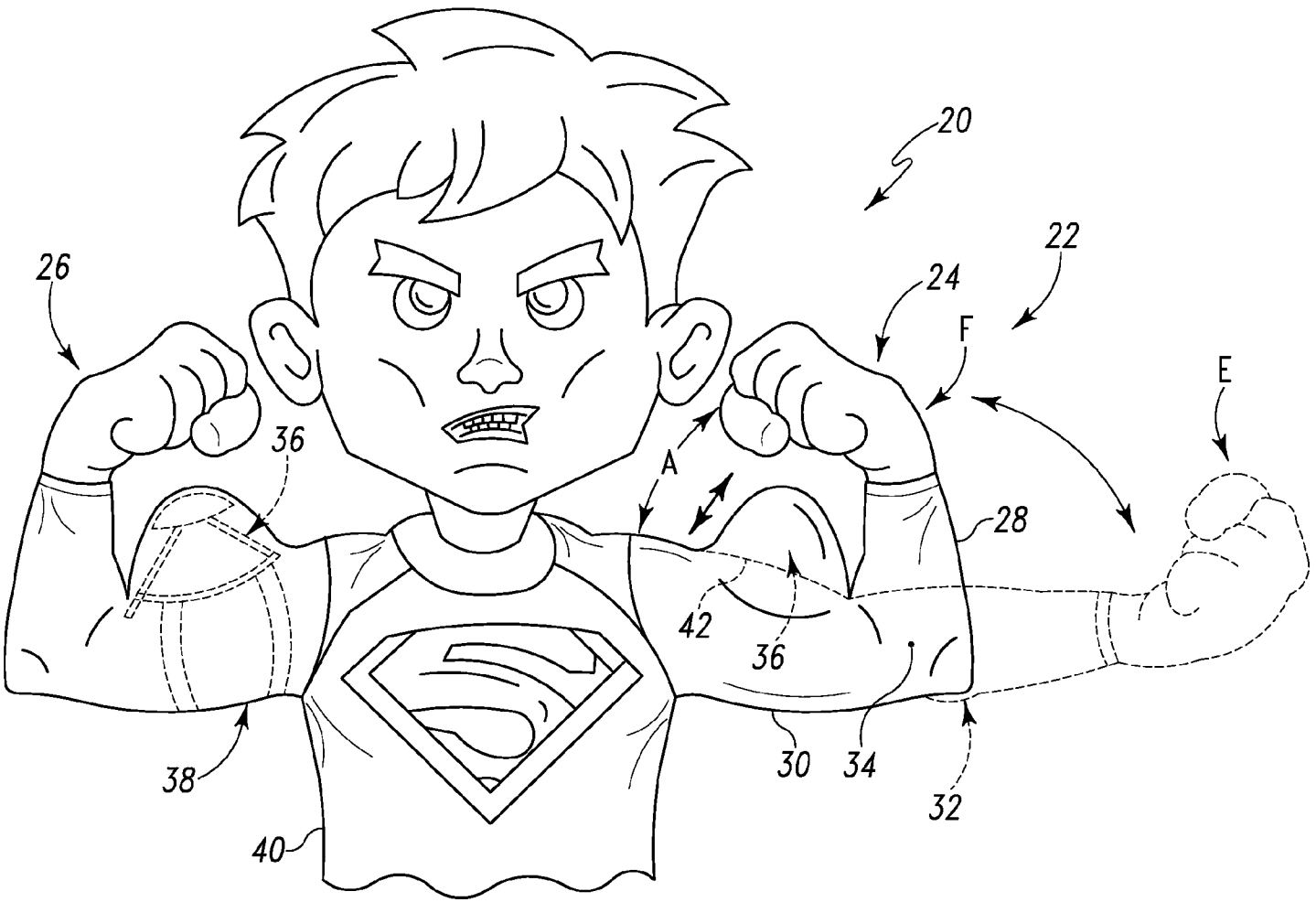
FIG. 1 is an illustration of a figure with a costume having a flexure mechanism on each of two arms.

FIG. 1 is a sketch of an upper portion of a figure 20. F*igure* 20 preferably is a person, but the figure may also be a doll, such as an action figure. F*igure* 20 may include various limbs or other appendages 22, such as arms 24 and 26. Arm 24 may include a lower arm member 28, an upper arm member 30, and an elbow joint 32 by which the arm members articulate or pivot, such as about a pivot axis 34. Lower arm member 30 may move between a flexed position F, shown in solid lines, and an extended position represented by dashed lines E. In the flexed position, the lower arm member may be at a transverse angle A (acute, perpendicular, obtuse) relative to the line or axis of the upper arm member. Although the fully extended position is shown as a reference, an angle change between any two relative positions of the articulating members may be used.

One or more flexure mechanisms 36 may be included in a costume 38 having a garment 40 made of a flexible fabric or other material. A flexure mechanism may change the apparent dimension of an associated articulated member with change in position of one articulated limb member relative to another. In this example, the articulating members may be the upper and lower arm members. The flexure mechanism may be mounted or otherwise adapted to function with a change in relative member positions. For example, the flexure mechanism 36 may portray the expansion of the biceps when the distal end or hand of the doll is raised toward the shoulder of the doll. This corresponds to relative articulation of the lower arm member from the extended position E toward the flexed position F.

Garment 40 may fit snuggly to the figure, covering the flexure mechanism. A flexible garment allows the flexure mechanism to extend, as shown in solid lines in FIG. 1, giving the appearance of a flexed muscle, such as when the arm is in a flexed configuration. A resilient garment may urge the flexure mechanism toward a retracted configuration, as represented by dashed line 42.

Other articulated limb members of the figure may also have associated flexure mechanisms 36. For example, a knee joint connecting an upper leg member with a lower leg member may be associated with a flexure mechanism. When the lower leg moves between an extended position and a flexed position, a flexure mechanism positioned on the lower leg member may make the "calf muscle" project laterally. Alternatively or additionally, a flexure mechanism positioned on the back of the upper leg member may make the "ham string muscle" appear to project laterally. Flexure mechanisms may also be placed at other articulated joints of a figure.

Figure 2:
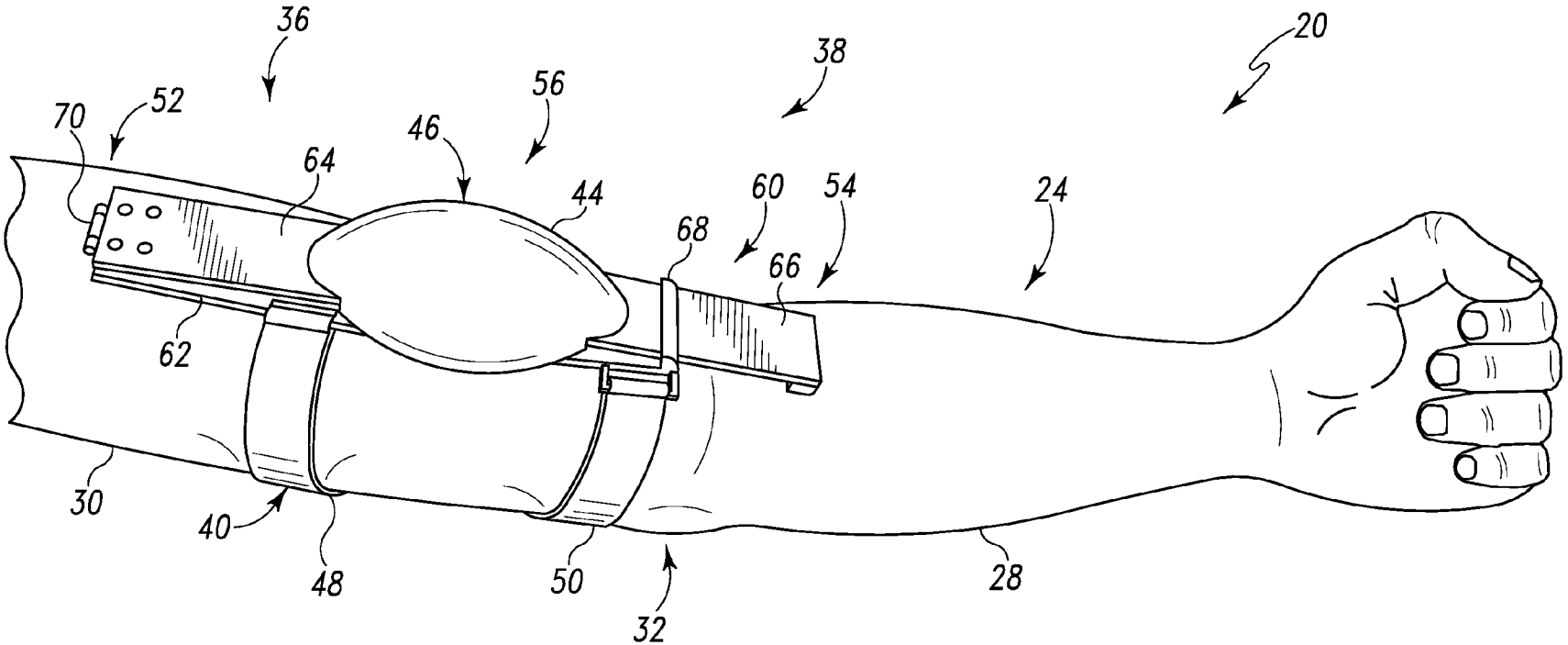
FIG. 2 is an illustration of a flexure mechanism on an extended arm of a figure.

FIGS. 2-8 illustrate the structure and function of flexure mechanism 36. In this example, a flexure mechanism 36 may include a cap 44 or other structure corresponding to a travel element 46 that moves laterally of an articulating limb member. FIG. 2 illustrates flexure element 36 positioned on an arm 24 without the garment 40. The garment 40 may be represented by straps 48 and 50 that support the flexure mechanism to upper arm 30. The straps may be sewn into the garment fabric or the flexure mechanism may be attached directly to the costume fabric. In an embodiment in which arm 24 is part of a doll, the flexure mechanism may be attached to a structural member of the doll arm, and then covered by a garment.

Generally, a costume may comprise a flexible garment configured to cover at least a portion of a limb of a humanoid figure, including a joint and a portion of each of two limb members connected by the joint; and a flexure mechanism covered by the garment, the flexure mechanism extending along a portion of the garment, and having a first end fixed in position relative to the garment, and a second end moveable relative to the garment and relative to the first end, the flexure mechanism including an intermediate portion between the first and second ends, the flexure mechanism being configured to move the intermediate portion laterally between an extended position in which the intermediate portion is spaced a first distance from a line extending between the first and second ends, and a retracted position that is closer to the line extending between the first and second ends than the extended position, when the second end is moved between a distal position spaced a second distance from the first end and a proximal position that is closer to the first end than the distal position.

Figure 3:
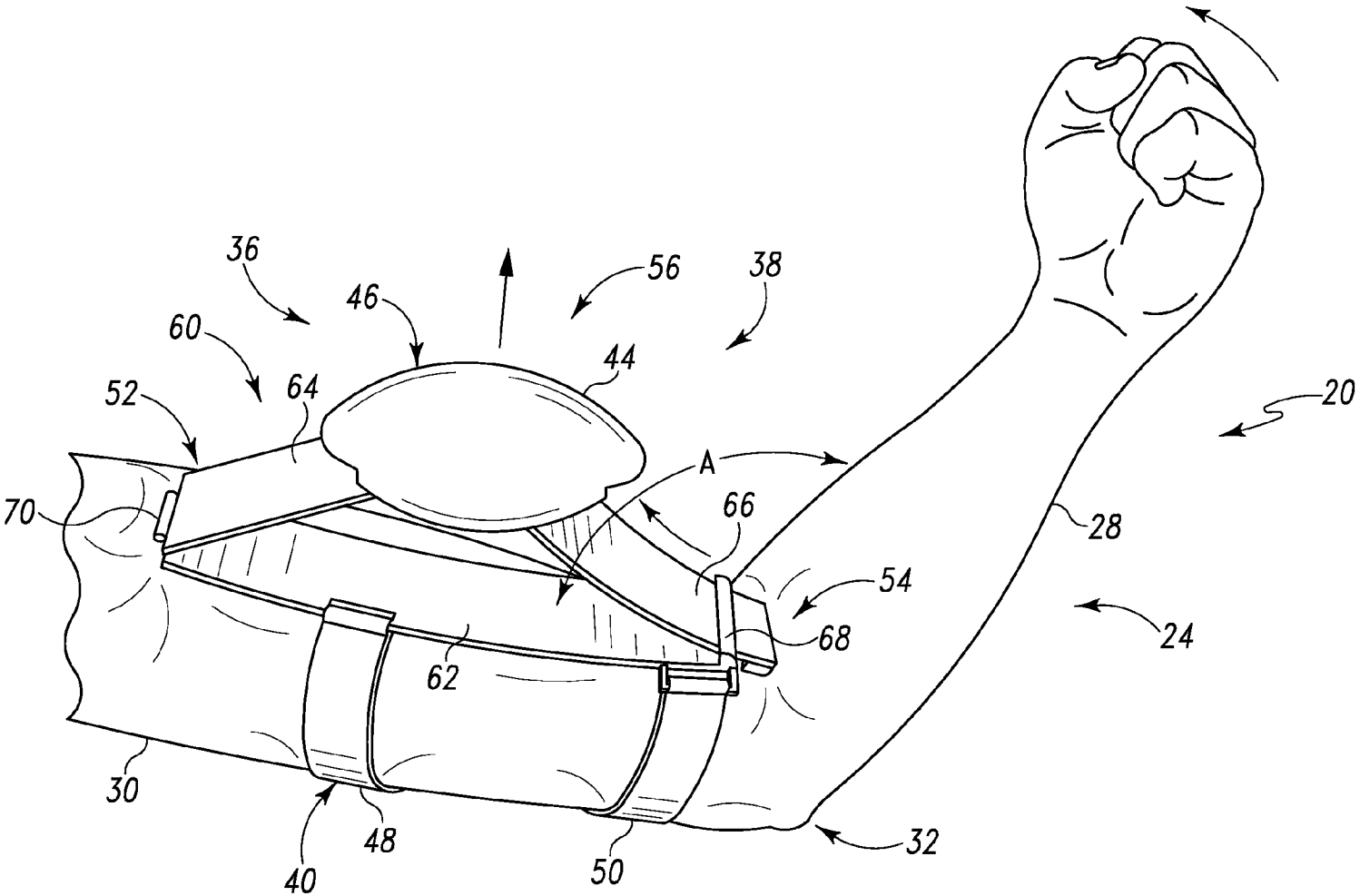
FIG. 3 is an illustration similar to FIG. 2 showing the flexure mechanism in a flexed configuration and the arm in a flexed position.

More specifically, and referring to FIGS. 2 and 3, flexure mechanism 36 may include a first end 52, a second end 54 and an intermediate portion 56, it being understood that the garment, not shown in these views, extends along and covers the flexure mechanism and arm of the figure. With the arm extended, as shown in FIG. 2, first end 52 is fixed in position on the upper arm and the second end 54 extends beyond elbow 32 and over lower arm 28. In this extended configuration, intermediate portion 56 is in a retracted position near the arm and near a line 58 extending between the first and second ends, shown in FIG. 4. In this configuration, the top of intermediate portion is approximately a distance D1 from line 58.

Figure 7:
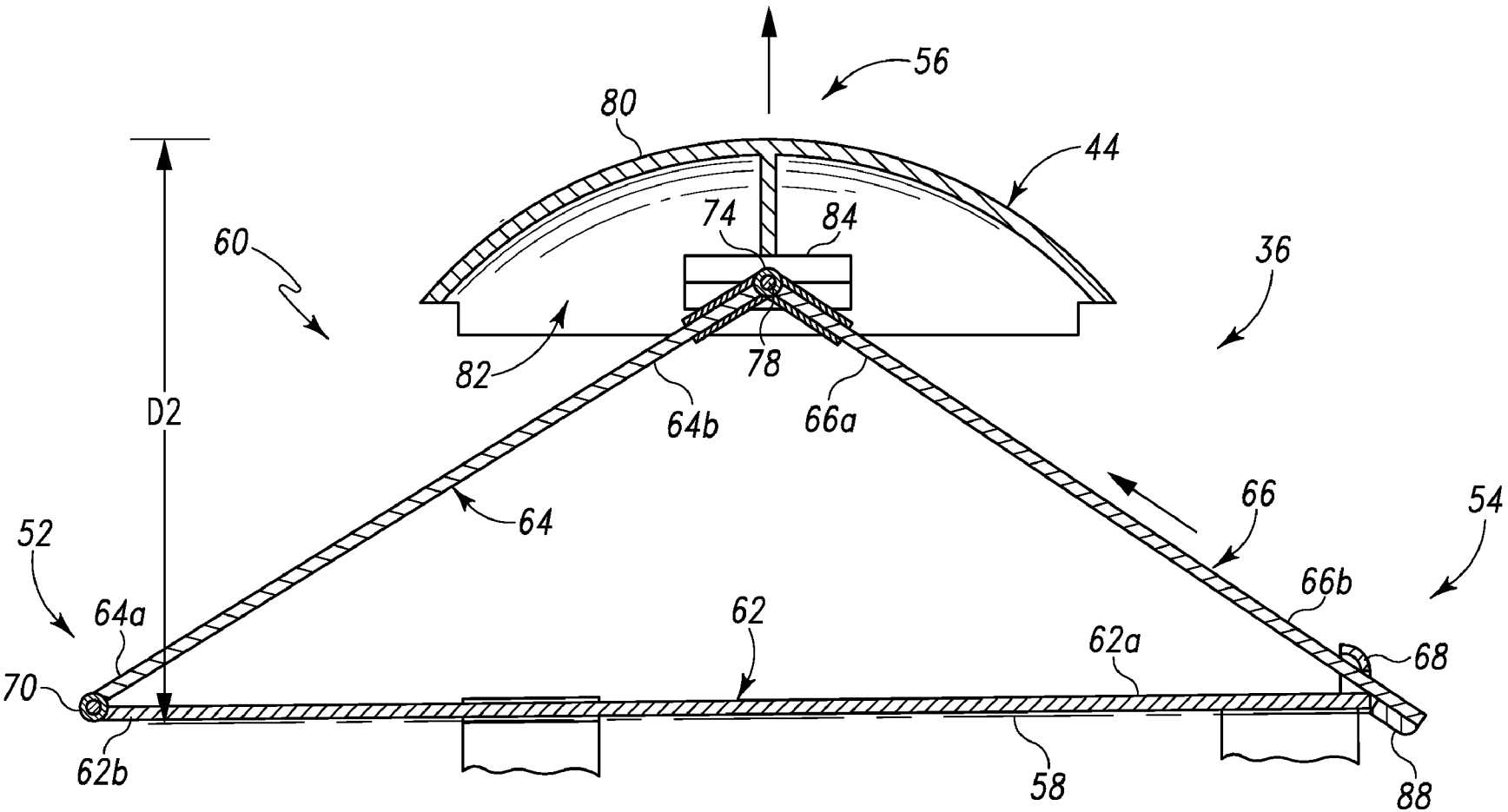
FIG. 7 is a cross section of the flexure mechanism of FIG. 4 in a fully flexed configuration.

With the arm retracted and the flexure mechanism in the retracted configuration, as shown in FIGS. 3 and 7, the top of the intermediate portion is approximately a distance D2 from line 58. Distance D2 is more than distance D1, providing the appearance, when covered by the garment, of an expanded shape, such as of a flexed muscle.

FIG. 2 illustrates the flexure mechanism in an extended configuration. Flexure mechanism 36 may include a linkage assembly 60 formed of a plurality of members or bars, such as a base bar 62, an intermediate bar 64, and a driving bar 66. Base bar 62 may be attached pivotably or otherwise held at an end 62*a* to upper arm 30. A second end 62*b* may have a sleeve, a retainer or other guide 68, such as a rim that may form a partial or complete loop through which driving bar 66 extends, and that allows bar 66 to slide through it.

Intermediate bar 64 may be hingedly attached at an end 64*a* to base bar end 62*a* by a hinge 70 for pivoting about a hinge axis 72. A second end 64*b* of bar 64 may be pivotably attached to an end 66*a* of driving bar 66 by a hinge 74 for pivoting about a hinge axis 76. Cap 44 may also be attached to hinge 72 for pivoting about hinge axis 76. In this example, bars 62, 64 and 66 are flat and generally parallel to hinge axes 72 and 76. Other forms and shapes of bars may also be used. These bars may also be made of a material, such as plastic, metal or wood, that is reasonably rigid to hold cap 44 over base bar 62 as it moves toward and away from the base bar.

Hinge 74 may include a pivot pin 78, extending along pivot axis 76. Cap 44 may include a shell 80 that forms a partial enclosure 82. Brackets 84 and 86 disposed on opposite ends of pin 78 may be attached to shell 80 inside enclosure 82. Brackets 84 and 86 may pivotably support cap 44 on pin 78 for pivoting about hinge axis 76.

Figure 4:
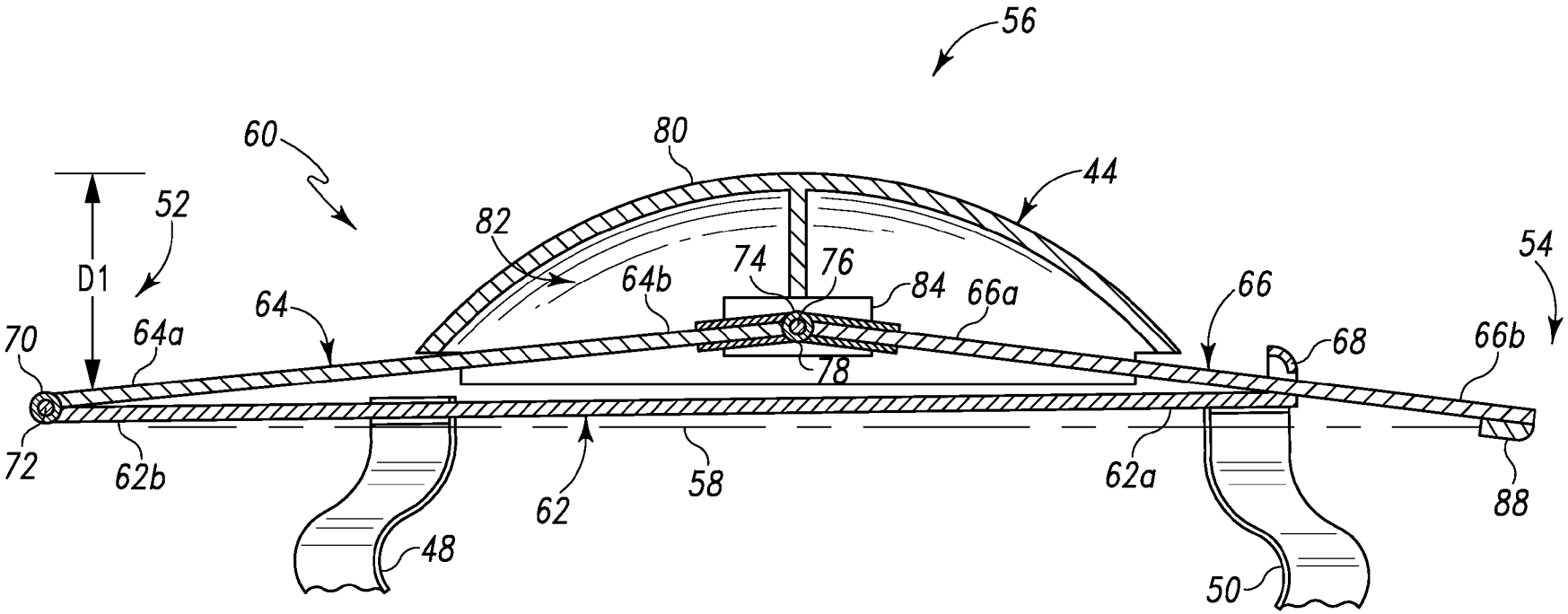
FIG. 4 is a cross section of the flexure mechanism of FIGS. 1 and 2 in an extended configuration.
Figure 5:
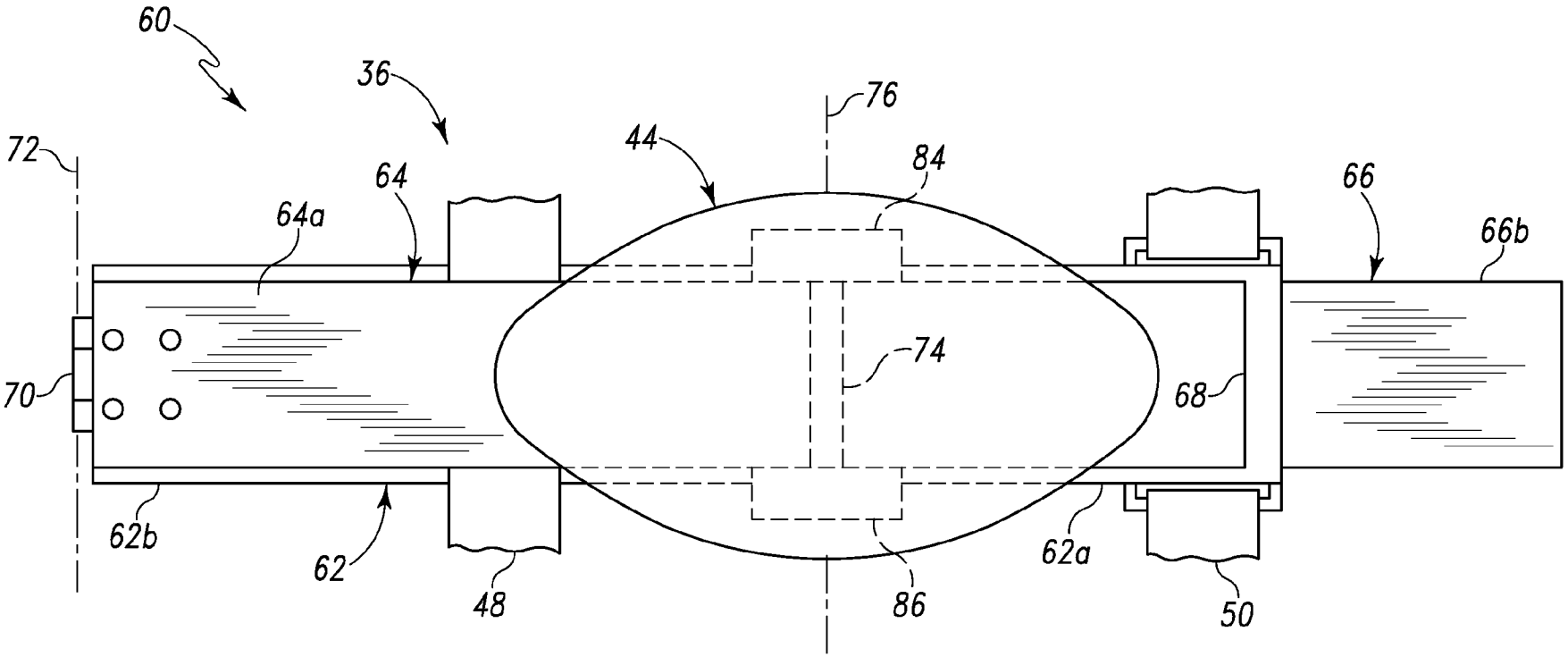
FIG. 5 is a top view of the flexure mechanism of FIG. 4 in an extended configuration.

Hinges 70 and 74, and guide 68 may allow controlled relative movement of bars 62, 64 and 66 in a triangular configuration. When in a fully extended position, as shown in FIGS. 2, 4 and 5, the three bars are collapsed, lying one on the other, as shown. More specifically, intermediate bar 64 and driving bar 66 extend generally in alignment on base bar 62. The intermediate bar has a length that is less than the base bar, and the combination of the lengths of the intermediate bar and the driving bar is more than the length of the base bar. Accordingly, the driving bar extends through guide 68 and the free end 66*b* of the driving bar extends beyond guide 68.

Figure 6:
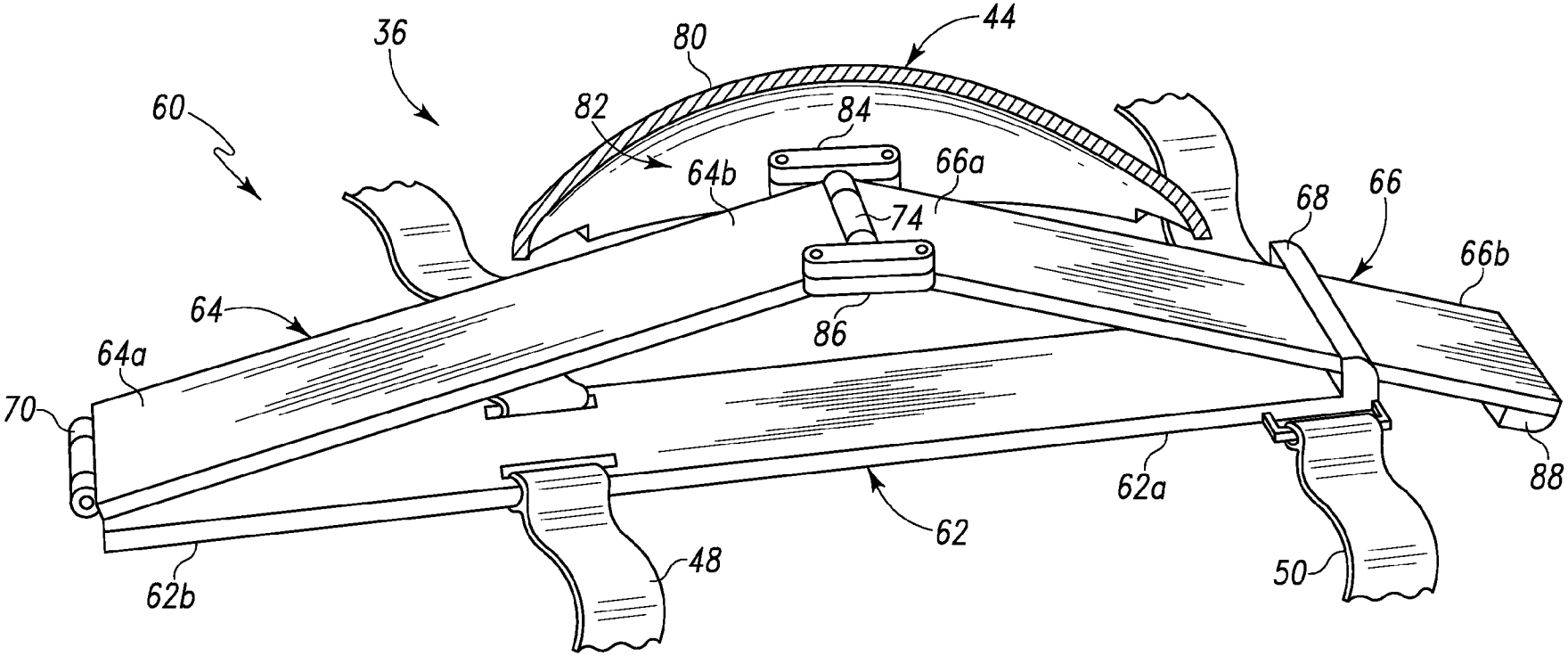
FIG. 6 is a partial cross-section and perspective view of the flexure mechanism of FIG. 4 in a partially flexed configuration.

FIG. 6 shows linkage assembly 60 in a partially flexed position, in which driving bar 66 is slid through guide 68, with driving bar end 66*b* moved closer to guide 68 and base bar end 62*a*. In this intermediate position, cap 44, hinge 74, and associated bar ends 64*b* and 66*a* are disposed away from base bar 62.

Figure 8:
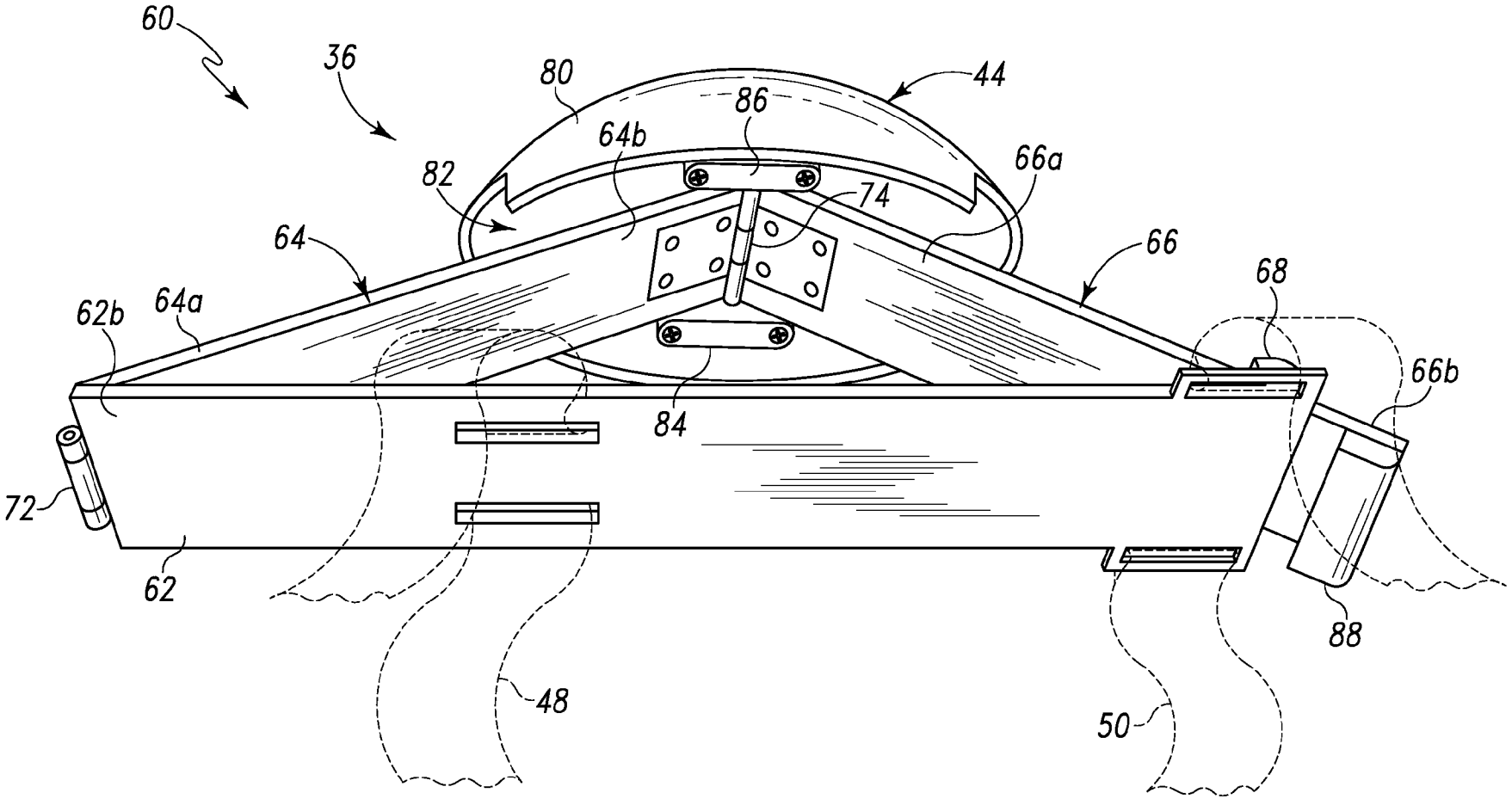
FIG. 8 is a perspective view from below the flexure mechanism showing the flexure mechanism in a flexed configuration.

FIGS. 3, 7 and 8 show the flexure mechanism in a more fully flexed configuration in which driving bar end 66*b* is near or has reached guide 68. In this configuration, hinge 74 and cap 44 are further spaced laterally from base bar 62 and line 58 by a distance of about D2. Movement of bar end 66*b* toward base bar 62 may be provided by the force of the lower arm of the wearer against end 66*b* as the lower arm is brought up toward the upper arm by bending the arm at the elbow. In an example in which the figure is a doll, this result occurs by movement of a lower arm member toward an upper arm member. End 66*b*, in that case, may actually be attached to the lower arm member so that it moves with the lower arm member to raise or lower the cap 44 or other travel element 46.

As shown in the figures, driving bar free end 66*b* may have a keeper or stop 88 in the form of a block attached to the end of the bar. This prevents end 66*b* from passing through guide 68, thereby limiting travel of the driving bar.

When the process is reversed, i.e., the person wearing the costume moves the arm from the flexed position toward the extended position, bar 66 slides through guide 68, and hinge 74 and cap 44 return toward a position adjacent to base bar 62, as shown in FIGS. 2 and 4. This return may be accomplished under the force of gravity of bars 64 and 66, as well as cap 44. This process may be further facilitated by garment 40 pressing down on cap 44. This may be yet further enhanced with a garment that is made of a resilient material that is stretched when the flexure mechanism moves from the extended configuration of FIG. 3 to the retracted configuration of FIG. 2

It will be appreciated, then, that the costume described may include a flexible garment including a garment arm configured to cover at least a portion of an arm of a person, including the upper arm, elbow and lower arm, the garment arm including an upper arm portion, an elbow portion and a lower arm portion; and a flexure mechanism disposed in and attached to the garment arm, the flexure mechanism including a base bar disposed in the upper arm portion of the garment and having first and second ends, an intermediate bar having first and second ends and having a length that is shorter than a length of the base member, a driving bar having first and second ends, a combined length of the intermediate and driving bars being longer than the length of the base member, a first hinge pivotingly connecting the first end of the base bar to the first end of the intermediate bar, a second hinge pivotingly connecting the second end of the intermediate bar with the first end of the driving bar, a guide attached to the second end of the base bar and forming at least a partial loop through which the driving bar freely extends, with the intermediate and driving bars extending along the base bar between the base bar and the garment, and the second end of the driving bar extending beyond the second end of the base bar passed the elbow portion of the garment into the lower arm portion, and a rounded cap mounted to the second hinge and disposed between the second hinge and the garment, whereby movement of the second end of the driving member toward the second end of the base member causes the second hinge to move the cap toward the garment and away from the base member.

A costume having one or more flexure mechanisms 36, may also have other related features. For example, a costume may include a breastplate, arm coverings and a cape. When used as part of a doll. The flexure mechanism may be attached to articulating members of a doll figure, and covered by a fabric, garment, skin or other covering of a "costume."

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Where the claims recite "a" or "a first" element or the equivalent thereof, such claims include one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

Inventions embodied in various combinations and subcombinations of features, functions, elements, and/or properties may be claimed through presentation of claims in a related application. Such claims, whether they are directed to different inventions or directed to the same invention, whether different, broader, narrower or equal in scope, are also regarded as included within the subject matter of the present disclosure.

The invention claimed is:

1. A costume comprising:

a flexible garment configured to cover at least a portion of a limb of a humanoid figure, including a joint and a portion of each of two limb members connected by the joint; and a flexure mechanism covered by the garment, the flexure mechanism extending along a portion of the garment, and having a first end fixed in position relative to the garment, and a second end moveable relative to the garment and relative to the first end, the flexure mechanism including an intermediate portion between the first and second ends, the flexure mechanism being configured to move the intermediate portion laterally between an extended position in which the intermediate portion is spaced a first distance from a line extending between the first and second ends, and a retracted position that is closer to the line extending between the first and second ends than the extended position, when the second end is moved between a distal position spaced a second distance from the first end and a proximal position that is closer to the first end than the distal position, the flexure mechanism including a first member having the first end and a third end, a second member having the second end and a fourth end, a first hinge coupling the third and fourth ends, a third member, and a second hinge coupling a fifth end of the third member to the first end of the first member, the intermediate portion including the first hinge and the third and fourth ends, and the first and second members pivoting about the first hinge as the second end moves between the distal and proximal positions, the third member including a sixth end in contact with the second member, the flexure mechanism further including a retainer attached to the sixth end of the third member, the retainer retaining the second member in contact with the sixth end of the third member as the second member moves along the sixth end of the third member allowing the second member to pivot slidingly relative to the third member as the second end of the second member moves between the distal and proximal positions.

2. The costume of claim 1, in which the flexure mechanism further includes a cap disposed between the intermediate portion and the garment.

3. The costume of claim 2, in which the cap is pivotingly mounted to the intermediate portion.

4. The costume of claim 2, in which the cap is resilient.

5. The costume of claim 2, in which the cap forms a partial enclosure and the intermediate portion extends into the enclosure.

6. The costume of claim 1, in which the retainer includes a rim extending at least partially around the second member.

7. The costume of claim 6, in which the rim forms a complete loop through which the second member passes.

8. The costume of claim 1, in which the first, second and third members are substantially rigid.

9. The costume of claim 8, in which the first and second hinges pivot about parallel pivot axes, and the first, second and third members are flat and extend in respective planes that are parallel to the pivot axes.

10. The costume of claim 1, in which the garment is resilient and urges the intermediate portion of the flexure mechanism toward the retracted position.

11. The costume of claim 1, in which the figure is a person and the garment is configured to cover at least a portion of the person's limb including a joint and a portion of each of two limb members joined by the joint, the flexure mechanism being attached to the garment.

12. The costume of claim 1, in which the figure is a doll.

13. The costume of claim 12, in which the flexure mechanism is attached to at least one of the limb members.

14. The costume of claim 13, in which the second end of the flexure mechanism moves between the distal position and the proximal position with movement of the other limb member about the joint.

15. A costume comprising:

a flexible garment including a garment arm configured to cover at least a portion of an arm of a person, including the upper arm, elbow and lower arm, the garment arm including an upper arm portion, an elbow portion and a lower arm portion; and a flexure mechanism disposed in and attached to the garment arm, the flexure mechanism including a base bar disposed in the upper arm portion of the garment and having first and second ends, an intermediate bar having first and second ends and having a length that is shorter than a length of the base member, a driving bar having first and second ends, a combined length of the intermediate and driving bars being longer than the length of the base member, a first hinge pivotingly connecting the first end of the base bar to the first end of the intermediate bar, a second hinge pivotingly connecting the second end of the intermediate bar with the first end of the driving bar, a guide attached to the second end of the base bar and forming at least a partial loop through which the driving bar freely extends for maintaining the driving bar in contact with the second end of the base bar as the driving bar moves through the guide with the driving bar slidingly pivoting relative to the base bar, with the intermediate and driving bars extending along the base bar between the base bar and the garment, and the second end of the driving bar extending beyond the second end of the base bar past the elbow portion of the garment into the lower arm portion, and a rounded cap mounted to the second hinge and disposed between the second hinge and the garment, whereby the person's lower arm, when bending about the elbow, presses directly against the second end of the driving member and moves the second end of the driving member toward the second end of the base member causing the driving bar to pass through the guide and the second hinge to move the cap toward the garment and away from the base member.

16. The costume of claim 15, in which the cap forms a partial enclosure and the second hinge is disposed in the partial enclosure.

17. The costume of claim 15, in which the base and intermediate bars are substantially flat and rigid.

18. The costume of claim 17, in which the first and second hinges pivot about parallel pivot axes, and the base, intermediate and driving bars are flat and extend in respective planes that are parallel to the pivot axes.

19. The costume of claim 15, in which the garment is resilient and urges the cap toward the base bar.

* * * * *

UNITED STATES PATENT AND TRADEMARK OFFICE

CERTIFICATE OF CORRECTION

PATENT NO. : 7,536,729 B2
APPLICATION NO. : 11/422298
DATED : May 26, 2009
INVENTOR(S) : Michael Strauss and John Rosella, Jr.

It is certified that error appears in the above-identified patent and that said Letters Patent is hereby corrected as shown below:

In column 5, line 14, the word "member" should be changed to --bar--; line 16, the word "member" should be changed to --bar--; line 30, the word "member" should be changed to --bar--; line 31, the word "member" should be changed to --bar--; line 33, the word "member" should be changed to --bar--.

In column 7, line 22, the word "member" should be changed to --bar--; line 25, the word "member" should be changed to --bar--.

In column 8, line 14, the word "member" should be changed to --bar--; line 15, the word "member" should be changed to --bar--; line 16, the word "member" should be changed to --bar--; line 18, the word "member" should be changed to --bar--.

Signed and Sealed this

Sixth Day of October, 2009

David J. Kappos

David J. Kappos
*Director of the United States Patent and Trademark Office*